US008939709B2

(12) United States Patent
Nanukuttan et al.

(10) Patent No.: US 8,939,709 B2
(45) Date of Patent: Jan. 27, 2015

(54) CLEARANCE CONTROL FOR A TURBINE

(75) Inventors: Biju Nanukuttan, Jabalpur (IN); Rakesh Adoor, Dwarka (IN); Hariharan Sundaram, Bangalore (IN); James Adaickalasamy, Bangalore (IN); Prasad Punna, Bangalore (IN)

(73) Assignee: General Electric Company, Schenectady, NY (US)

( * ) Notice: Subject to any disclaimer, the term of this patent is extended or adjusted under 35 U.S.C. 154(b) by 586 days.

(21) Appl. No.: 13/184,628

(22) Filed: Jul. 18, 2011

(65) Prior Publication Data

US 2013/0022442 A1 Jan. 24, 2013

(51) Int. Cl.
*F01D 11/18* (2006.01)
*F01D 11/22* (2006.01)

(52) U.S. Cl.
CPC ..... *F01D 11/22* (2013.01); *F05B 2280/5006* (2013.01); *F05D 2300/505* (2013.01); *Y10S 277/931* (2013.01); *Y10S 277/932* (2013.01)
USPC ..... 415/14; 415/1; 415/118; 415/173.2; 415/173.3; 60/527; 60/528; 277/355; 277/931; 277/932

(58) Field of Classification Search
USPC ..... 415/1, 14, 17, 118, 173.1–173.5, 174.1; 60/527, 528; 277/355, 931–932
See application file for complete search history.

(56) References Cited

U.S. PATENT DOCUMENTS

| | | | | |
|---|---|---|---|---|
| 3,227,418 | A * | 1/1966 | West | 415/173.1 |
| 3,584,967 | A | 6/1971 | Zerlauth | |
| 3,628,884 | A | 12/1971 | Mierley, Sr. | |
| 3,754,833 | A | 8/1973 | Remberg | |
| 4,112,582 | A | 9/1978 | Beckershoff | |
| 5,197,853 | A * | 3/1993 | Creevy et al. | 415/173.1 |
| 5,536,126 | A * | 7/1996 | Gross | 411/411 |
| 5,921,749 | A | 7/1999 | McLaurin et al. | |
| 6,457,936 | B1 | 10/2002 | Leach et al. | |
| 7,260,892 | B2 | 8/2007 | Schilling et al. | |
| 2003/0030220 | A1 * | 2/2003 | Datta | 277/355 |
| 2004/0115043 | A1 * | 6/2004 | Lee et al. | 415/135 |
| 2007/0003411 | A1 * | 1/2007 | Manzoori | 415/173.2 |
| 2008/0131270 | A1 | 6/2008 | Paprotna et al. | |
| 2011/0049810 | A1 * | 3/2011 | Ferryman et al. | 277/355 |

FOREIGN PATENT DOCUMENTS

| | | | |
|---|---|---|---|
| AU | 720250 | B2 | 5/2000 |
| EP | 1467066 | A2 | 10/2004 |

(Continued)

OTHER PUBLICATIONS

Search Report and Written Opinion from EP Application No. 12176533.3 dated Sep. 25, 2012.

*Primary Examiner* — Christopher Verdier
(74) *Attorney, Agent, or Firm* — Dority & Manning, PA

(57) ABSTRACT

A system for operating a turbine includes a rotating component and a non-rotating component separated from the rotating component by a clearance. A first actuator is connected to the non-rotating component, and the first actuator comprises a shape-memory alloy. A method for operating a turbine includes sensing a parameter reflective of a clearance between a non-rotating component and a rotating component and generating a parameter signal reflective of the clearance. The method further includes generating a control signal to at least one actuator based on the parameter signal and moving at least a portion of the non-rotating component relative to the rotating component to change the clearance.

10 Claims, 7 Drawing Sheets

(56) References Cited

FOREIGN PATENT DOCUMENTS

| | | | | | |
|---|---|---|---|---|---|
| EP | 1686243 | A2 | | 8/2006 | |
| EP | 2239423 | A1 | | 10/2010 | |
| EP | 2466075 | A | | 6/2012 | |
| JP | 57195803 | A | | 12/1982 | |
| JP | 58206807 | A | | 12/1983 | |
| JP | 60111004 | A | | 6/1985 | |
| JP | 61-152906 | A | * | 7/1986 | ..... F01D 11/08 |
| JP | 62-75001 | A | * | 4/1987 | ..... F01D 11/08 |

* cited by examiner

CLEARANCE CONTROL FOR A TURBINE

FIELD OF THE INVENTION

The present invention generally involves a system and method for operating a turbine. In particular embodiments of the present invention, the system and method adjusts a clearance between rotating and non-rotating components in the turbine.

BACKGROUND OF THE INVENTION

Turbines are widely used in a variety of aviation, industrial, and power generation applications to perform work. Each turbine generally includes alternating stages of peripherally mounted stator vanes and rotating blades. The stator vanes may be attached to a stationary component such as a casing that surrounds the turbine, and the rotating blades may be attached to a rotor located along an axial centerline of the turbine. A compressed working fluid, such as steam, combustion gases, or air, flows along a gas path through the turbine to produce work. The stator vanes accelerate and direct the compressed working fluid onto the subsequent stage of rotating blades to impart motion to the rotating blades, thus turning the rotor and performing work. Compressed working fluid that leaks around or bypasses the stator vanes or rotating blades reduces the efficiency of the turbine. As a result, the casing surrounding the turbine often includes a shroud or shroud segments that surround and define the outer perimeter of the gas path to reduce the amount of compressed working fluid that bypasses the stator vanes or rotating blades.

The clearance between the shroud and the rotating blades in the turbine is an important design consideration that balances efficiency and performance on the one hand with manufacturing and maintenance costs on the other hand. For example, reducing the clearance between the shroud and the rotating blades generally improves efficiency and performance of the turbine by reducing the amount of combustion gases that bypass the rotating blades. However, reduced clearances may also result in additional manufacturing costs to achieve the reduced clearances and increased maintenance costs attributed to increased rubbing, friction, or impact between the shroud and the rotating blades. The increased maintenance costs may be a particular concern in turbines in which the rotating blades rotate at speeds in excess of 1,000 revolutions per minute, have a relatively large mass, and include delicate aerodynamic surfaces. In addition, reduced clearances may result in excessive rubbing, friction, or impact between the shroud and the rotating blades during transient operations when the casing and/or shroud expands or contracts at a different rate than the rotating blades during startup, shutdown or other variations in operation.

Various systems and methods are known in the art for controlling or adjusting eccentricities between the shroud and the rotating blades. For example, U.S. Pat. No. 6,126,390 describes a passive heating-cooling system in which airflow from a compressor or combustor is metered to the turbine casing to heat or cool the turbine casing, depending on the temperature of the incoming air. U.S. patent publication 2009/0185898, assigned to the same assignee as the present invention, describes another passive system that includes an inner turbine shell having false flanges at the top and bottom to reduce eccentricities caused by transient operations.

The conventional passive systems to control or adjust eccentricities between the shroud and the rotating blades, however, assume a uniform circumferential expansion of the rotor and/or shroud and generally do not account for manufacturing or operational changes in the clearance between the shroud and the rotating blades. For example, manufacturing or assembly tolerances may produce inherent manufacturing eccentricities between the inner shroud and the rotating blades, changing the clearance between the shroud and the rotating blades around the circumference of the turbine. Similarly, bearing oil lift, thermal growth of the bearing structures, vibrations, uneven thermal expansion of the turbine components, casing slippage, gravity sag, and so forth may further change the clearance between the shroud and the rotating blades around the circumference of the turbine over time.

Anticipated manufacturing eccentricities may be accounted for by designing a minimum clearance between the shroud and the rotating blades, and some anticipated operational eccentricities may be accounted for by making static adjustments to the minimum and/or maximum clearances between the shroud and rotating blades during cold assembly. However, additional systems and methods that can actively adjust the clearance between the shroud and the rotating blades based on actual operating parameters and/or sensed operating conditions would be useful.

BRIEF DESCRIPTION OF THE INVENTION

Aspects and advantages of the invention are set forth below in the following description, or may be obvious from the description, or may be learned through practice of the invention.

One embodiment of the present invention is a system for operating a turbine that includes a rotating component and a non-rotating component separated from the rotating component by a clearance. A first actuator is connected to the non-rotating component, and the first actuator comprises a shape-memory alloy.

Another embodiment of the present invention is a system for operating a turbine that includes a rotating component and a non-rotating component separated from the rotating component by a clearance. At least one actuator is connected to the non-rotating component, and a sensor provides a parameter signal reflective of at least one of a maximum or a minimum clearance between the non-rotating component and the rotating component. A controller is connected to the sensor, receives the parameter signal from the sensor, and generates a control signal to the at least one actuator based on the parameter signal.

Embodiments of the present invention may also include a method for operating a turbine that includes sensing a parameter reflective of a clearance between a non-rotating component and a rotating component and generating a parameter signal reflective of the clearance between the non-rotating component and the rotating component. The method further includes generating a control signal to at least one actuator based on the parameter signal and moving at least a portion of the non-rotating component relative to the rotating component to change the clearance between the non-rotating component and the rotating component.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
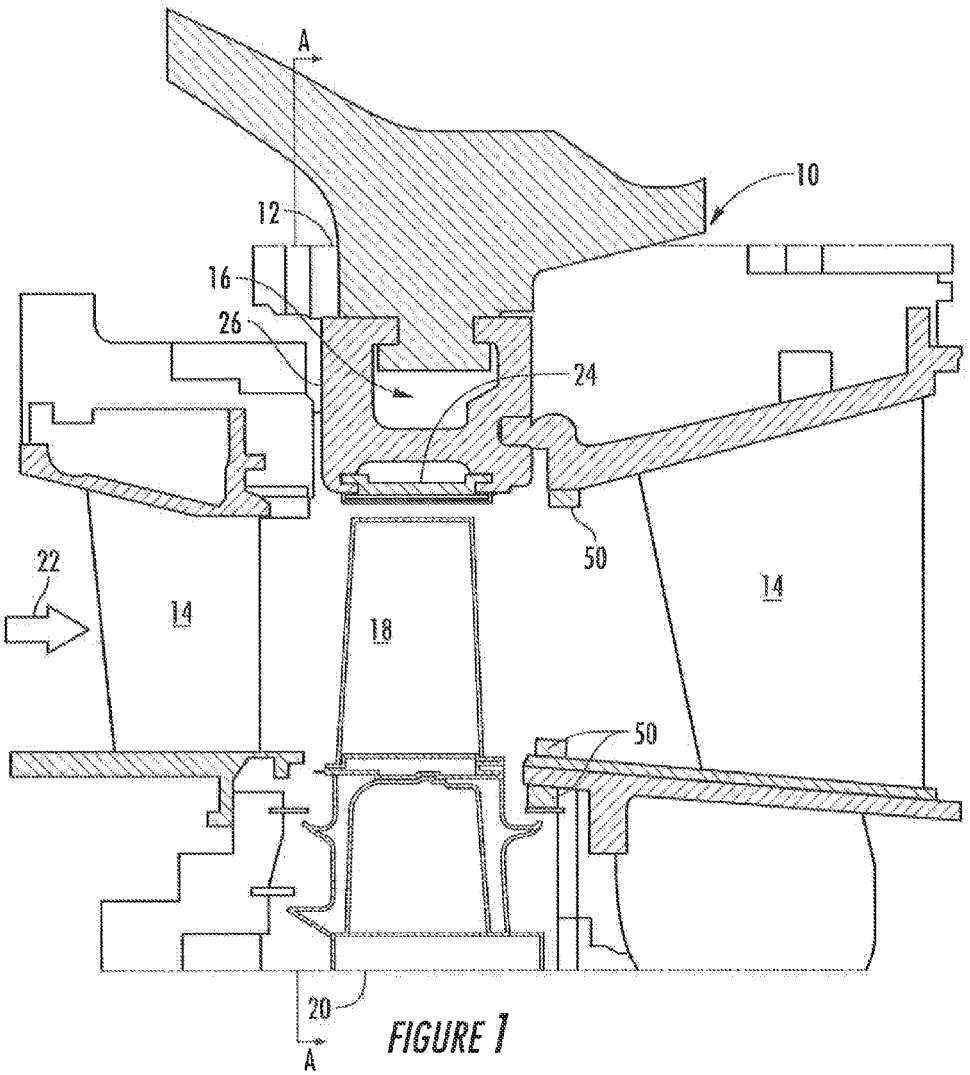
FIG. 1 is a simplified cross-section view of a portion of a turbine according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide a system and method for operating a turbine. Specifically, the system and method may include an actuator that dynamically and actively adjusts the position of one or more non-rotating components proximate to one or more rotating components to achieve a desired clearance between the non-rotating and rotating components. In particular embodiments, the actuator may comprise a shape-memory alloy, a micro-electrical mechanical system (MEMS), a micro-opto-electrical mechanical system (MOEMS), or other mechanical operator adapted to operate in a high temperature environment. One or more sensors may be positioned to monitor one or more operating parameters and to generate a parameter signal reflective of the clearance between the non-rotating and rotating components. A controller in communication with the one or more sensors may receive the parameter signals and provide a control signal to the actuator to reposition the non-rotating component to achieve the desired clearance between the non-rotating and rotating components.

FIG. 1 provides a simplified cross-section view of a portion of a turbine 10 according to one embodiment of the present invention. As shown in FIG. 1, the turbine 10 may include one or more non-rotating and rotating components surrounded by a casing 12. The non-rotating components may include, for example, stationary stator vanes 14 and shroud segments 16 attached to the casing 12. The rotating components may include, for example, rotating blades 18 attached to a rotor 20. A compressed working fluid 22, such as steam, combustion gases, or air, flows along a hot gas path through the turbine 10 from left to right as shown in FIG. 1. The first stage of stator vanes 14 accelerates and directs the compressed working fluid 22 onto the first stage of rotating blades 18, causing the first stage of rotating blades 18 and rotor 20 to rotate. The compressed working fluid 22 then flows across the second stage of stator vanes 14 which accelerates and redirects the compressed working fluid 22 to the next stage of rotating blades (not shown), and the process repeats for each subsequent stage.

As shown in FIG. 1, each shroud segment 16 generally comprises an inner shroud segment 24 and an outer shroud segment 26 attached to the radially inward portion of the casing 12. The inner and outer shroud segments 24, 26 circumferentially surround and define the hot gas path to reduce the amount of compressed working fluid 22 that bypasses the stator vanes 14 or rotating blades 18. As used herein, the term "shroud" may encompass and include virtually any static or stationary hardware in the hot gas path exposed to the temperatures and pressures associated with the compressed working fluid 22. For example, in the particular embodiment shown in FIG. 1, the inner shroud segment 24 is located radially outward of the rotating blades 18, while in other particular embodiments the shroud segments 16 may also be located radially inward of the rotating blades 18 or radially inward or outward of the stator vanes 14.

Figure 2:
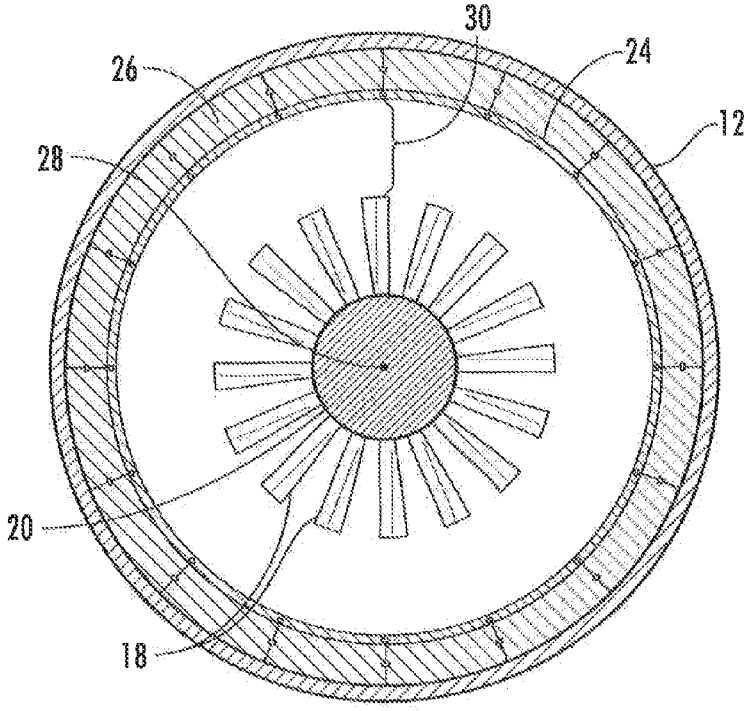
FIG. 2 is an exemplary axial view of the turbine shown in FIG. 1 along line A-A showing an even clearance between rotating and non-rotating components.
Figure 3:
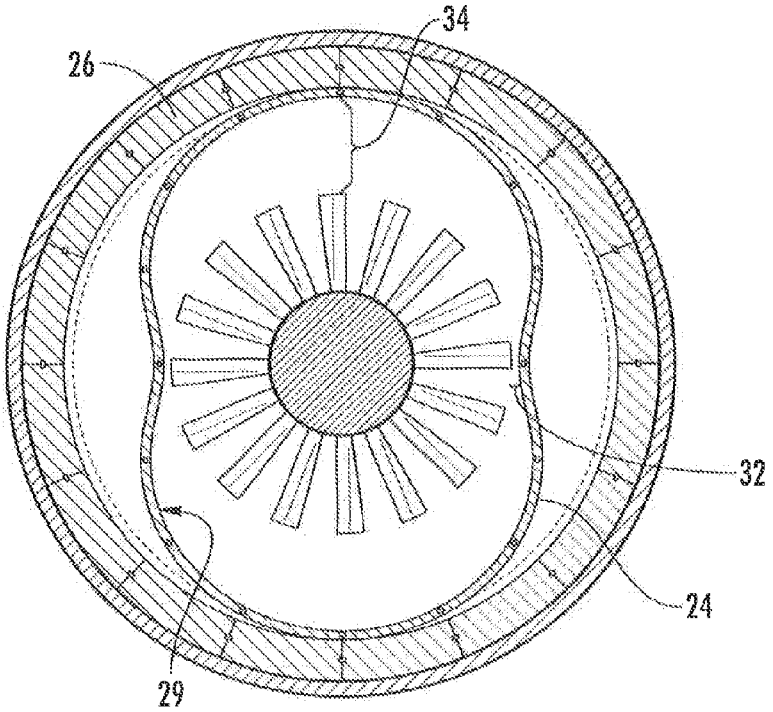
FIG. 3 is an exemplary axial view of the turbine shown in FIG. 1 along line A-A showing uneven clearances between the rotating and non-rotating components.

FIGS. 2 and 3 provide exemplary axial views of the turbine 10 along line A-A shown in FIG. 1 to illustrate various clearances (exaggerated for illustrative purposes) between the non-rotating and rotating components. As shown in each figure, the rotor 20 is generally aligned with or near an axial centerline 28 of the turbine 10, and the rotating blades 18 connect circumferentially around the rotor 20 and extend radially outward. The inner and outer shroud segments 24, 26 circumferentially surround the rotating blades 18 to define an inner perimeter shape 29 and create a clearance 30 between the rotating blades 18 and the inner shroud segments 24. As shown in FIG. 2, the inner perimeter shape 29 is ideally round, and the clearance 30 between the rotating blades 18 and the inner shroud segments 24 is ideally uniform around the turbine 10. However, as shown in FIG. 3, manufacturing or assembly tolerances and/or operational changes may significantly alter inner perimeter shape 29 of the inner shroud segments 24 (non-rotating components) and thus the clearance 30 (exaggerated for illustrative purposes) between the rotating blades 18 and the inner shroud segments 24 around the turbine 10. As a result, a minimum clearance 32 may cause excessive rubbing or friction between the rotating blades 18 and the inner shroud segments 24, leading to excessive wear and/or premature failure. Similarly, a maximum clearance 34 may allow excessive amounts of the compressed working fluid 22 to bypass the rotating blades 18, reducing the efficiency of the turbine 10.

Figure 4:
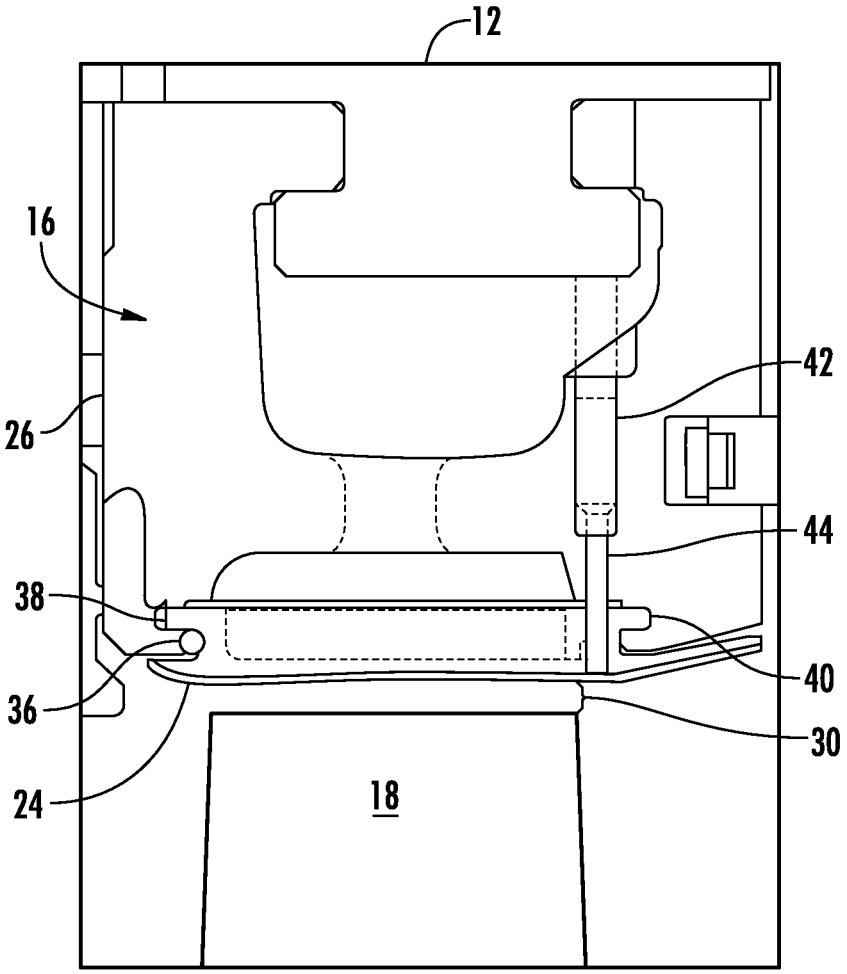
FIG. 4 is an enlarged cross-section of a portion of the turbine shown in FIG. 1 according to a first embodiment of the present invention.

FIG. 4 provides an enlarged cross-section of a portion of the turbine 10 shown in FIG. 1 according to a first embodiment of the present invention. As previously described, the turbine 10 includes one or more non-rotating and rotating components surrounded by the casing 12. Specifically, the non-rotating components may be the shroud segments 16 that circumferentially surround and are separated from the rotating blades 18 (the rotating components) by the clearance 30.

In this particular embodiment, each shroud segment 16 again generally comprises inner and the outer shroud segments 24, 26, and the outer shroud segment 26 and/or casing 12 constitute relatively stationary components, whereas the inner shroud segment 24 constitutes a movable component that may move relative to the outer shroud segment 26 and/or casing 12. For example, a hinge 36 may pivotally connect a first end 38 of the inner shroud segment 24 to the outer shroud segment 26 so that a second end 40 of the inner shroud segment 24 may move with respect to the outer shroud segment 24. In this manner, the inner shroud segment 24 (movable component) may pivot with respect to the outer shroud segment 26 (stationary component) to adjust the clearance 30 between the inner shroud segment 24 and the rotating blades 18.

Figure 5:
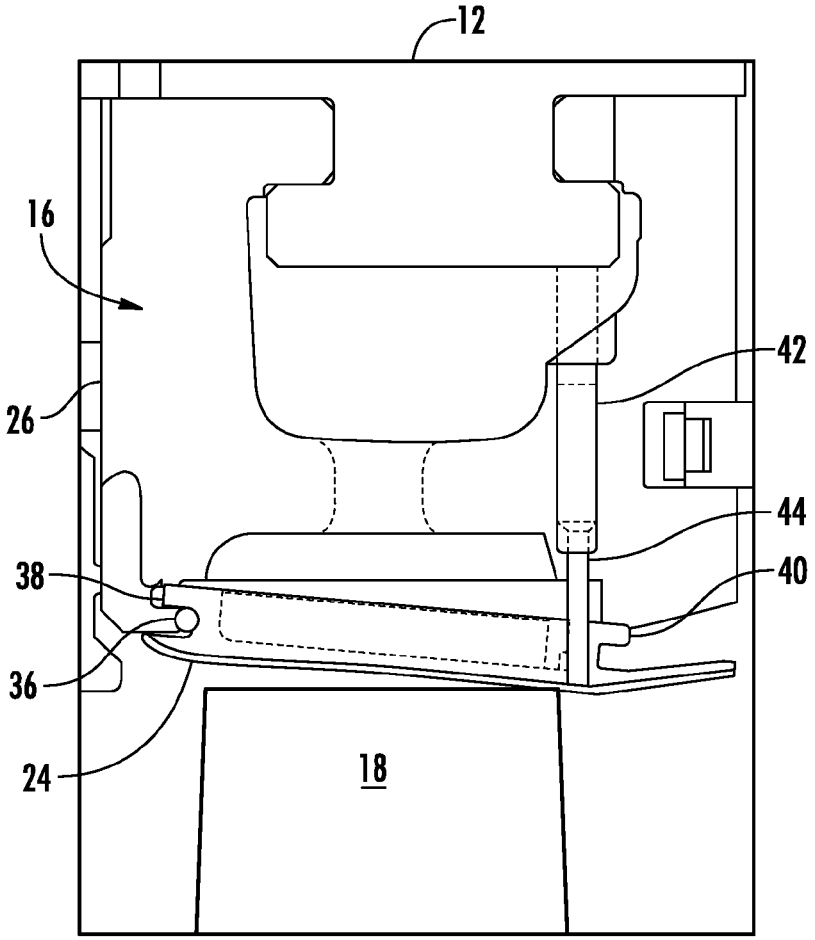
FIG. 5 is an enlarged cross-section of the portion of the turbine shown in FIG. 4 adjusted to change the clearance between the rotating and non-rotating components.

An actuator 42 is connected to one or more of the non-rotating components to reposition at least a portion of the non-rotating components to adjust the clearance 30 between the non-rotating components and the rotating components. Specifically, as shown in FIGS. 4 and 5, the actuator 42 may be connected proximate to the second end 40 of the inner shroud segment 24 to separate at least a portion of the inner shroud segment 24 from the outer shroud segment 26 and/or casing 12. In this manner, the actuator 42 may pivot the second end 40 of the inner shroud segment 24 radially with respect to the rotating blades 18 to adjust the clearance 30 between the inner shroud segment 24 and the rotating blades 18.

The actuator 42 may comprise virtually any mechanical device adapted to operate in a high temperature environment and capable of moving one component with respect to another. For example, the actuator 42 may comprise a hydraulic or pneumatic piston, a motor-operated linkage, a micro-electrical mechanical system (MEMS), a micro-opto-electrical mechanical system (MOEMS), or a shape-memory alloy 44, as shown in FIGS. 4 and 5. As used herein, the term "shape-memory alloy" includes various alloys also known in the art as smart metals, memory metals, memory alloys, muscle wires, or smart alloys whose physical shape or length changes with temperature changes. For example, the shape-memory alloy 44 may have a curved or shorter length at lower temperatures, as shown in FIG. 4, and a straight or longer length at higher temperatures, as shown in FIG. 5. The straightening or lengthening of the shape-memory alloy 44 at higher temperatures may thus pivot or move at least a portion of the inner shroud segment 24 radially with respect to the outer shroud segment 26 to reduce the clearance 30 between the inner shroud segment 24 and the rotating blades 18. The shape-memory alloy 44 may be made from various alloy combinations that exhibit the desired changes at the anticipated temperatures. For example, the shape-memory alloy 44 may comprise copper-zinc-aluminium-nickel, copper-aluminum-nickel, nickel-titanium, or other alloys of zinc, copper, gold, and iron. In particular embodiments, the shape-memory alloy 44 may include approximately 15-35% by weight platinum to enhance the responsiveness of the shape-memory alloy 44 to the high temperature environment associated with the compressed working fluid 22 flowing through the hot gas path.

Figure 6:
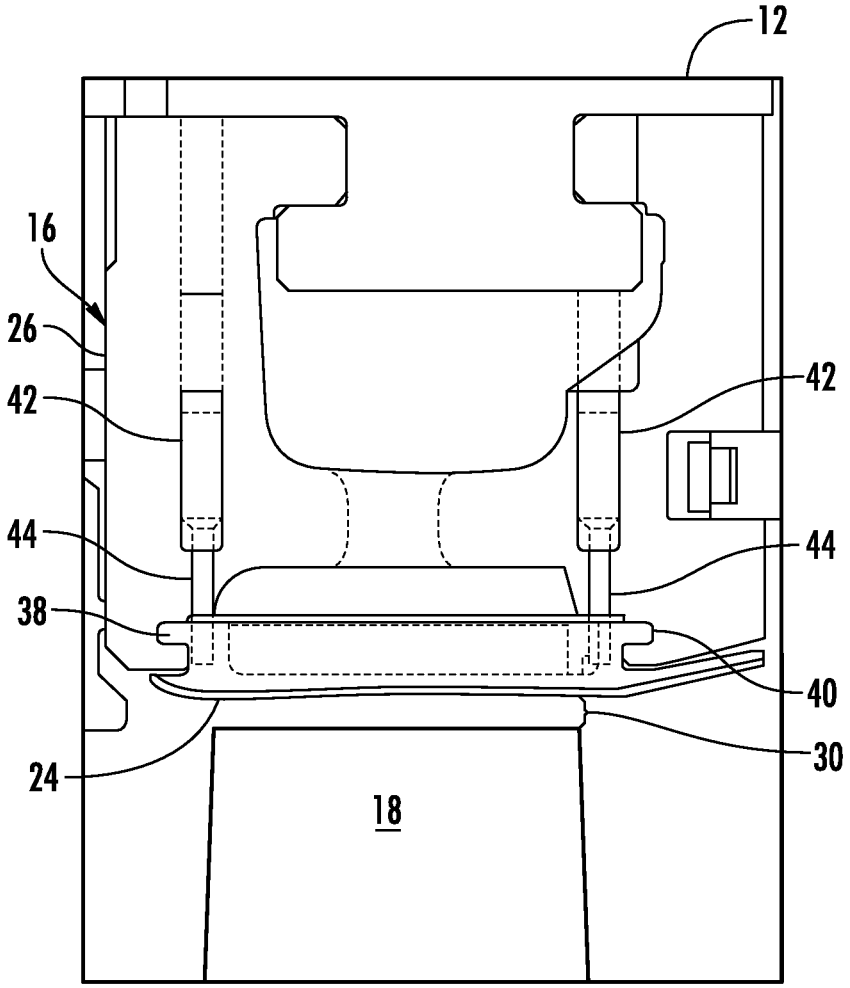
FIG. 6 is an enlarged cross-section of a portion of the turbine shown in FIG. 1 according to a second embodiment of the present invention.

FIG. 6 provides an enlarged cross-section of a portion of the turbine 10 shown in FIG. 1 according to a second embodiment of the present invention. In this particular embodiment, the turbine 10 again includes one or more non-rotating and rotating components as previously described with respect to the embodiment shown in FIGS. 4 and 5. Specifically, the shroud segments 16 (the non-rotating components) circumferentially surround and are separated from the rotating blades 18 (the rotating component) by the clearance 30. Each shroud segment 16 again generally comprises inner and the outer shroud segments 24, 26, and the outer shroud segment 26 and/or casing 12 constitute relatively stationary components, whereas the inner shroud segment 24 constitutes the movable component that may move relative to the outer shroud segment 26 and/or casing 12 to adjust the clearance 30 between the inner shroud segment 24 and the rotating blades 18.

The particular embodiment shown in FIG. 6 further includes two actuators 42 connected to the non-rotating component. Specifically, a first actuator 42 may be connected proximate to the first end 38 of the inner shroud segment 24, and a second actuator 42 may be connected proximate to the second end 40 of the inner shroud segment 24 axially and/or radially displaced from the first actuator 42. The first and second actuators 42 may comprise, for example, the shape-memory alloy 44 previously described with respect to the embodiment shown in FIGS. 4 and 5 so that the straightening or lengthening of the shape-memory alloy 44 at higher temperatures may thus move at least a portion of the inner shroud segment 24 radially with respect to the outer shroud segment 26 and/or casing 12 to reduce the clearance 30 between the inner shroud segment 24 and the rotating blades 18.

Figure 7:
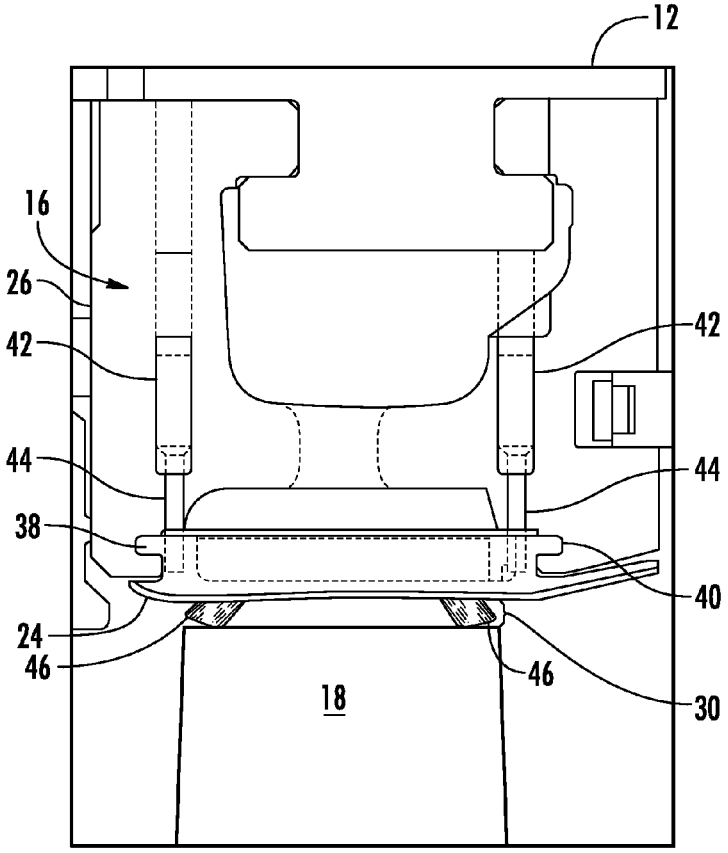
FIG. 7 is an enlarged cross-section of a portion of the turbine shown in FIG. 1 according to a third embodiment of the present invention.

FIG. 7 provides an enlarged cross-section of a portion of the turbine 10 shown in FIG. 1 according to a third embodiment of the present invention. In this particular embodiment, a plurality of bristle-like strands 46 made from the shape-metal alloy 44 may be attached to the radially inward portion of the inner shroud segment 24. The bristle-like strands 46 extend radially inward from the inner shroud segment 24 to the rotating blades 18 to effectively modify the inner perimeter shape 29 and provide a barrier that impedes or restricts the flow of the compressed working fluid 22 around the rotating blades 18. The shape-metal alloy 44 in the bristle-like strands 46 may cause the bristle-like strands 46 to alternately straighten/extend or curve/retract in response to temperature changes, thus changing the inner perimeter shape 29 and maintaining the barrier between the inner shroud segments 26 and rotating blades 18.

Figure 8:
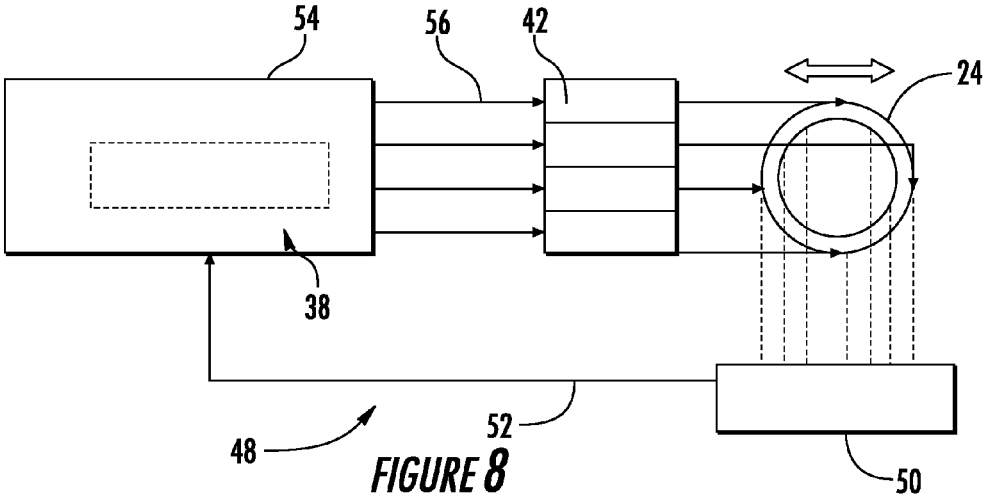
FIG. 8 is a block diagram of the system according to one embodiment of the present invention.

FIG. 8 provides a block diagram of a control system 48 according to one embodiment of the present invention. As shown in FIG. 8, the control system 48 may include one or more sensors 50 located throughout the turbine 10 or associated components, such as a combustor, generator, or other components included in a gas turbine. Various types of sensors 50 are known and used in the art, and any one or combination of such sensors 50 may be used within the scope and spirit of the present invention. For example, the sensors 50 may be passive devices, such as capacitive or inductance sensors that react to a change in measured capacitance or inductance generated by passage of the rotating blades 18 near the sensor 50, with the magnitude of change reflecting a relative degree of clearance 30 between the inner shroud segment 24 and the rotating blades 18. Typically, these types of capacitive sensors 50 are mounted in recesses within the inner shroud segment 24 so as to be flush with an inner circumferential surface of the inner shroud segment 24. In alternative embodiments, the sensors 50 may comprise, for example, an optical sensor, a pressure sensor, a flow sensor, and/or a temperature sensor positioned to measure various operating parameters reflective of the clearance 30 between the inner shroud segment 24 and the rotating blades 18. For example, as shown in FIG. 1, the sensors 50 may be located at various positions along the hot gas path to optically measure the clearance 30 or electronically measure temperatures, pressures, and/or flows that provide a reliable indication of the clearance 30. It should be readily appreciated that the present invention is not limited by the type or configuration of sensors 50, unless specifically recited in the claims, and that any manner or configuration of known or developed sensors 50, or other devices, may be utilized to detect the clearance 30 by measuring or detecting a parameter that is indicative or reflective of the clearance 30 between the inner shroud segment 24 and the rotating blades 18.

As shown in FIG. 8, each sensor 50 generates a parameter signal 52 reflective of the clearance 30 based on the measured parameter. For example, the parameter signal 52 may reflect the minimum or maximum clearances 32, 34 between the inner shroud segment 24 and the rotating blades 18 as previously illustrated in FIG. 3. A controller 54 in communication with the one or more sensors 50 may receive the parameter signals 52 from the sensors 50. As described herein, the technical effect of the controller 54 is to transmit one or more control signals 56 to the various actuators 42 to remotely position the associated inner shroud segments 24 to achieve a desired clearance 30 between the inner shroud segments 24 and the rotating blades 18. The controller 54 may comprise a stand alone component or a sub-component included in any computer system known in the art, such as a laptop, a personal computer, a mini computer, or a mainframe computer. The various controller 54 and computer systems discussed herein are not limited to any particular hardware architecture or configuration. Embodiments of the systems and methods set forth herein may be implemented by one or more general purpose or customized controllers adapted in any suitable manner to provide the desired functionality. For example, the controller 54 may be adapted to provide additional functionality, either complementary or unrelated to the present subject matter. When software is used, any suitable programming, scripting, or other type of language or combinations of languages may be used to implement the teachings contained herein. However, some systems and methods set forth and disclosed herein may also be implemented by hard-wired logic or other circuitry, including, but not limited to, application-specific circuits. Of course, various combinations of computer-executed software and hard-wired logic or other circuitry may be suitable as well.

The controller 54 may thus be configured to generate the one or more control signals 56 to the various actuators 42 to remotely position the associated inner shroud segments 24 or other movable components to achieve a desired clearance 30 between the inner shroud segments 24 (non-rotating component) and the rotating blades 18. As the actuators 42 reposition the inner shroud segments 24 or other movable components, the sensors 50 continue to monitor the various operating parameters and generate associated parameter signals 52. It should be readily appreciated that the controller 54 may include any number of control features, such as a dampening or time delay circuit, or any other type of known closed-loop feedback function to ensure that the control system 48 directs the minimum number of required adjustments to maintain the clearance 30 within acceptable limits. For example, the controller 54 may be configured to direct incremental adjustments by the actuators 42 to re-position the inner shroud segments 24 or other movable components and to have a predefined wait period between each adjustment to allow any change in the sensed parameters to approach steady state prior to making subsequent adjustments.

Figure 9:
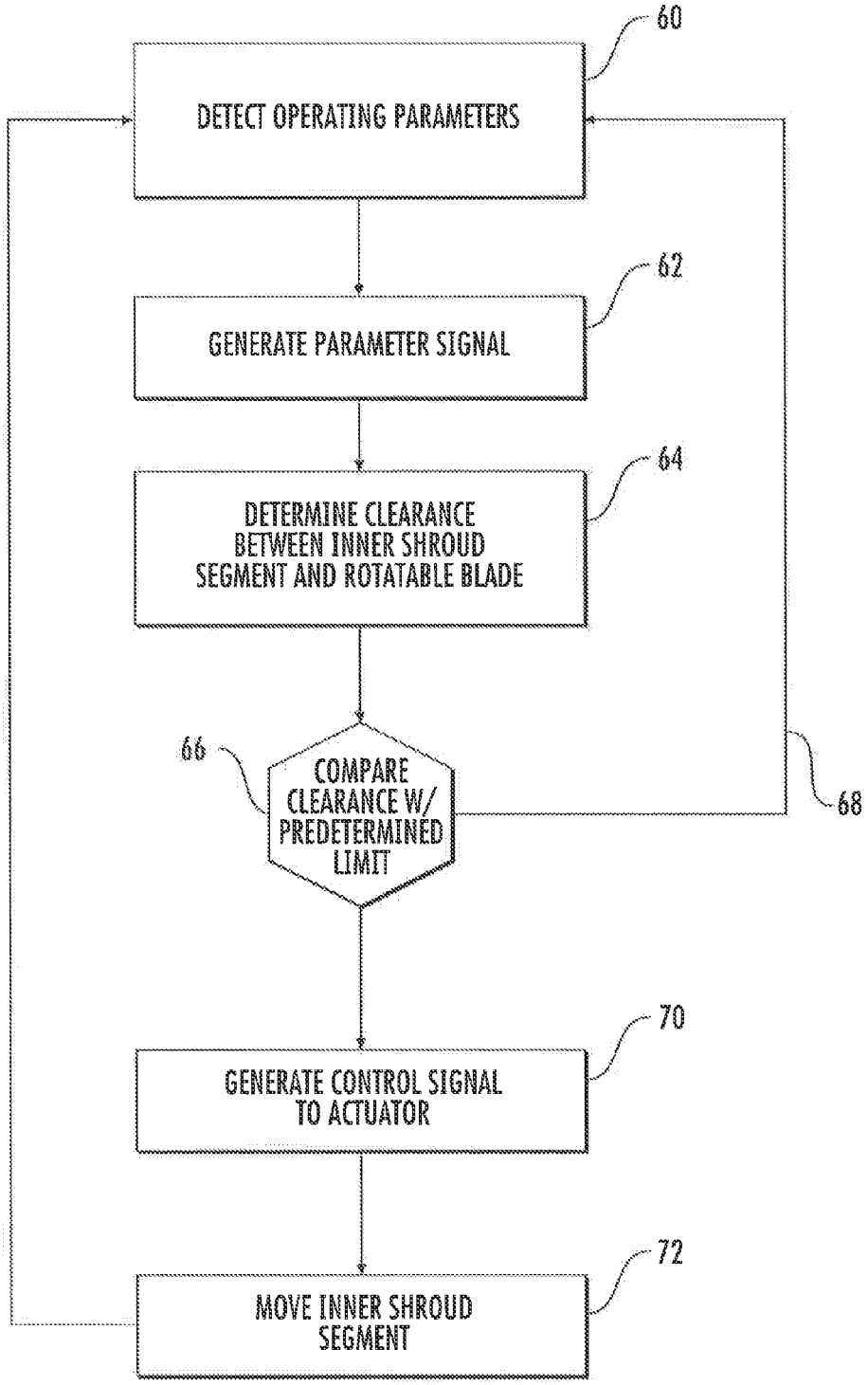
FIG. 9 is a block diagram of an algorithm for the system according to one embodiment of the present invention.

FIG. 9 provides a block diagram of an algorithm 50 for the control system 48 according to one embodiment of the present invention. At block 60, the one or more sensors 50 detect and measure the various operating parameters reflective of the clearance 30, and at block 62, the one or more sensors 50 generate the parameter signals 52 reflective of the clearance 30. At block 64, the controller 54 receives and assimilates the parameter signals 52 and determines or calculates the clearance 30 between the inner shroud segments 24 (non-rotating components) and the rotating blades 18.

At block 66, the controller 54 compares the calculated clearance 30 with predetermined limits for maximum and minimum allowable clearances. If the calculated clearance 30 is within the predetermined limits, as shown by line 68, no further adjustments are necessary, and the process repeats. If the calculated clearance 30 exceeds one or more of the predetermined limits, the controller 54 generates the control signals 56 to the actuators 42, as indicated by block 70. At block 72, the actuators 42 move at least a portion of the inner shroud segment 24 (movable component) relative to the rotating blades 18 (rotating component) to change the clearance 30, and the process repeats as indicated by line 74. As a result, the control system 48 directs changes the inner perimeter shape 29 defined by the inner shroud segments 24. As discussed above, the adjustments made by the actuators 42 may be in incremental steps, or may be in a single step calculated to achieve the desired clearance 30.

It should be readily appreciated that the particular control system 48 and algorithm 58 described and illustrated with respect to FIGS. 8 and 9 are not a limitation of the present invention unless specifically recited in the claims, and various types of control systems and algorithms may be readily devised by those skilled in the art to achieve the desired clearance 30 between the inner shroud segments 24 and the rotating blades 18.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine, comprising:

an outer shroud segment fixed to a casing, the outer shroud segment having a forward end, an aft end, an outer portion fixed to the outer casing and an inner portion;

an inner shroud segment disposed proximate to the inner portion, the inner shroud segment having a first end, a second end and an inner surface, the first end pivotally connected to the outer shroud proximate to the forward end;

a rotatable blade having a tip portion, the tip portion radially separated from the inner surface to form a clearance therebetween; and an actuator extending radially inwardly from the outer shroud segment and in contact with the inner shroud segment at one end of the actuator proximate to the second end of the inner shroud segment,

2. The turbine as in claim 1, wherein the actuator actuates radially inwardly to reposition the second end of the inner shroud to adjust the clearance between the tip portion and the inner surface.

3. The turbine as in claim 1, wherein the actuator actuates in an entirely linear motion.

4. The turbine as in claim 1, wherein the actuator comprises a shape-memory alloy.

5. The turbine as in claim 4, wherein the shape-memory alloy comprises approximately 15-35% by weight platinum.

6. The turbine as in claim 1, wherein the first end of the inner shroud is pivotally connected to the outer shroud segment via a hinge.

7. The turbine as in claim 1, further comprising bristle strands extending inwardly from the inner surface of the inner shroud segment towards the tip portion of the rotatable blade.

8. The turbine as in claim 7, wherein the bristle strands comprise shape-memory alloy.

9. The turbine as in claim 1, further comprising a sensor that provides a parameter signal reflective of at least one of a maximum or a minimum clearance between the inner surface of the inner shroud segment and the tip portion of the rotatable blade.

10. The turbine as in claim 9, further comprising a controller connected to the sensor, wherein the controller receives the parameter signal from the sensor and generates a control signal to the actuator based on the parameter signal.

* * * * *

UNITED STATES PATENT AND TRADEMARK OFFICE

CERTIFICATE OF CORRECTION

PATENT NO. : 8,939,709 B2
APPLICATION NO. : 13/184628
DATED : January 27, 2015
INVENTOR(S) : Biju Nanukuttan et al.

It is certified that error appears in the above-identified patent and that said Letters Patent is hereby corrected as shown below:

IN THE CLAIMS

Column 8, Claim 1, line 59 reads “segment,” should read --segment.--

Signed and Sealed this
First Day of December, 2015

Michelle K. Lee

Michelle K. Lee
*Director of the United States Patent and Trademark Office*